US005338027A

United States Patent [19]

Rehkemper et al.

[11] Patent Number: 5,338,027

[45] Date of Patent: Aug. 16, 1994

[54] TOSSING AND CATCHING PLAY OBJECT

[76] Inventors: Jeffrey Rehkemper, 1636 N. Wells, Ste. 2006, Chicago, Ill. 60614; Mike Burroughs, 8196 Timberhill, Cordova, Tenn. 38018; Steven Rehkemper, 679 N. Milwaukee Ave., Chicago, Ill. 60622; Kimberlee Osborne, 8253 Red Creek, Cordova, Tenn. 38108

[21] Appl. No.: 893,313

[22] Filed: Jun. 3, 1992

[51] Int. Cl.[5] ..... A63B 43/02; A63B 43/00

[52] U.S. Cl. ..... 273/58 K; 273/346; 273/424; 273/428

[58] Field of Search ..... 273/346, 58 K, 412, 273/424, 425, 426, 428, DIG.30, DIG.20

[56] References Cited

U.S. PATENT DOCUMENTS

| | | | |
|---|---|---|---|
| 1,542,012 | 6/1925 | Spilman | 273/428 X |
| 4,209,936 | 7/1980 | Sklar | 273/424 X |
| 4,294,447 | 10/1981 | Clark | 273/428 X |
| 4,657,253 | 4/1987 | Lerner et al. | 273/428 X |
| 4,735,420 | 4/1988 | Seidler | 273/346 X |
| 4,802,880 | 2/1989 | Shaw | 273/428 X |
| 4,826,179 | 5/1989 | Callaghan | 273/428 |
| 4,927,141 | 5/1990 | Paranto | 273/58 K |
| 4,943,066 | 7/1990 | Lathim et al. | 273/428 X |

*Primary Examiner*—William H. Grieb

*Attorney, Agent, or Firm*—Burton Ehrlich; Louis J. Bachand

[57] ABSTRACT

A tossing and catching play object in the shape of a ball or flying disc, made of a relatively malleable rubber or plastic material, having animal limb shaped appendages extending outward from the surface of the play object. The appendages are substantially flat in one dimension and provide aerodynamic forces to the play object when the play object is tossed through the air. The trajectory or path of the play object thus becomes variable and unpredictable, thus adding a degree of challenge in playing with the object. Also, the spherical embodiments of the invention are prevented from rolling far away from the intended receiver if not caught.

11 Claims, 3 Drawing Sheets

FIG. 1
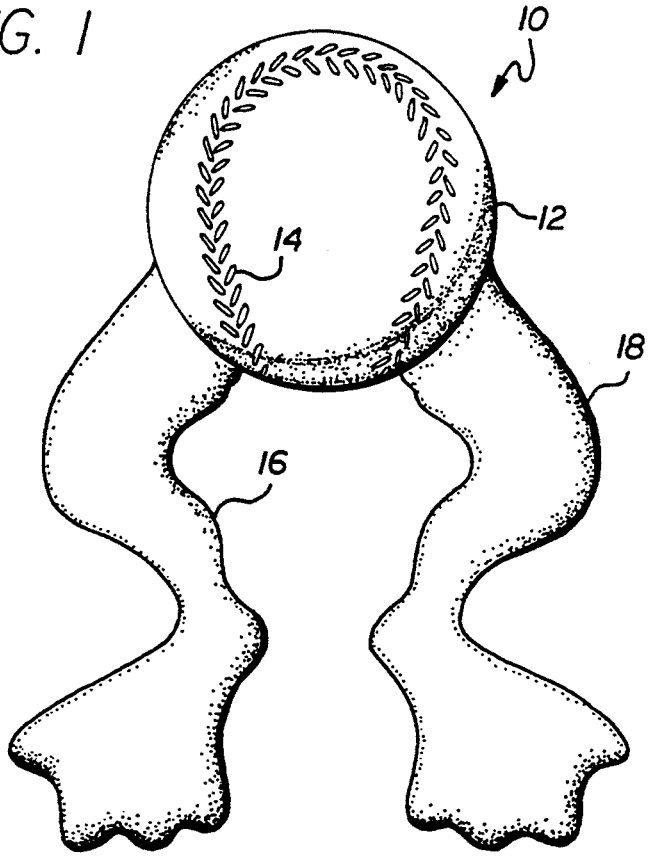
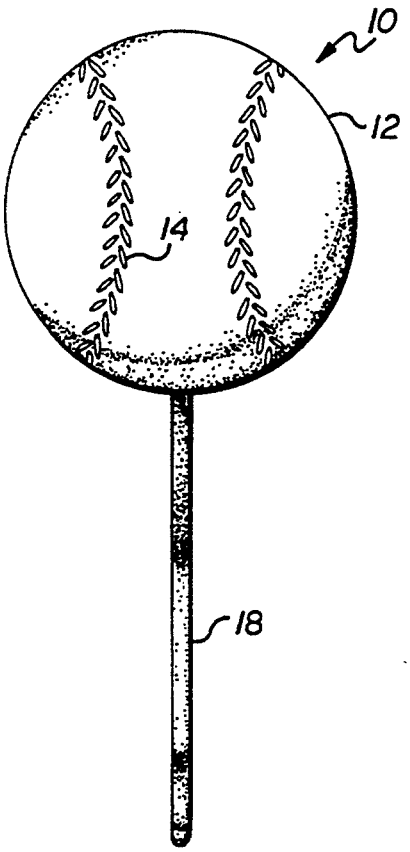
FIG. 2
FIG. 3
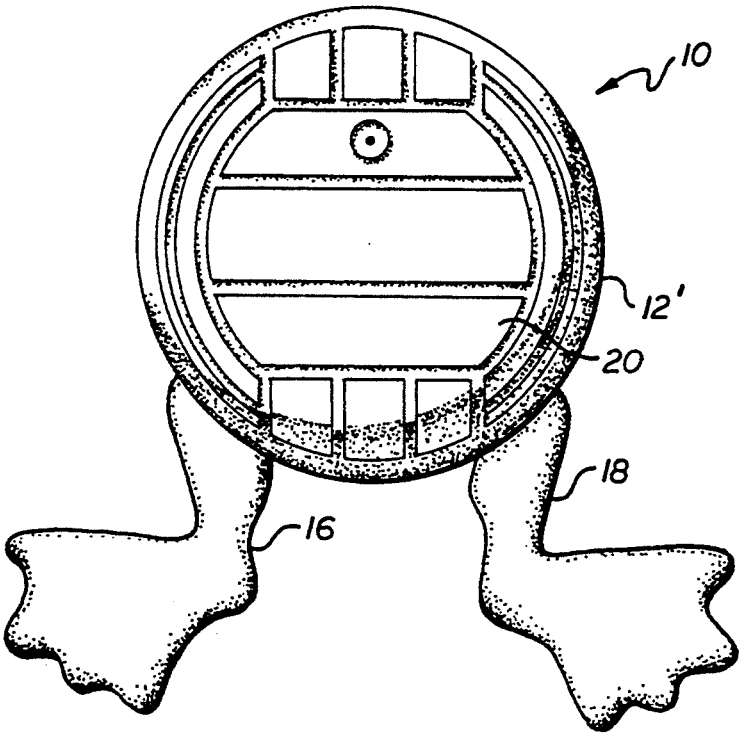

TOSSING AND CATCHING PLAY OBJECT

The present invention relates generally to a tossing, bouncing and catching play object used primarily as a playing toy for children, and more particularly to a substantially circular or round tossing, bouncing and catching play object which includes flat appendages in the shape of fanciful designs including animal limbs, such as frog legs, or any other configuration, extending from the play object to provide both unique aerodynamic forces to the play object when it is in flight, and unpredictable bouncing, as well as a novelty feature enhancing the attractiveness of the play object to children.

BACKGROUND OF INVENTION

Spherical and circular ball-like and disc-like play objects that are adapted to be tossed or bounced by one person and caught by another are well known in the art. Baseballs, basketballs, volleyballs, tennis balls and flying discs are but a few examples of such play objects. For use by younger children, these play objects are normally composed of softer rubber or plastic materials so as to be easily tossed, bounced and caught by a child without injury upon impact with the hands or other parts of the body. Certain round playing balls have imitation stitching embossed on the surface to simulate a baseball, and to provide aerodynamic forces to the ball when tossed through the air. However, the aerodynamic forces acting on the play object are usually insufficient at low flight speeds to provide an interesting trajectory to the play object.

When the play object is in the form of a spherical ball, if a child to whom the ball is tossed misses the ball, the ball will continue to roll away from the reach of the child. In most cases, the child will not retrieve the ball, causing an interruption in the play of the game with the child.

It is a primary object of the present invention to provide a tossing, bouncing and catching play object which includes appendages extending therefrom to provide unique aerodynamic forces to the play object when it is tossed through the air or bounced, such that the flight of the play object is unpredictable and fanciful.

A further object of the present invention is to provide a tossing, bouncing and catching play object which has appendages extending therefrom, which could be in the shape of an animal's limbs such as frog legs, or any other fanciful shape, to make the flight of the object more attractive to children.

Another object of one embodiment of the present invention is to provide a tossing, bouncing and catching substantially round play object which will not roll away from a child when the play object lands on the floor near the child, making it easier for the child to retrieve the play object.

Yet another object of one embodiment of the present invention is to provide a play object having appendages in the shape of animal limbs or other fanciful design extending therefrom to provide aerodynamic forces to the play object in flight, wherein the play object is covered with pliable loop-like elements which are adapted to engage pliable hook-like elements on a hard receiving surface, such that the playing object becomes removably attached to the hard receiving surface.

SURFACE OF THE INVENTION

These and other objects of the present invention are provided in a tossing, bouncing and catching play object comprising a ball-like or flying disc-like resilient element adapted to be tossed through the air and caught, appendage means attached at one end and extending outward from the play object in a fanciful shape, which could be the shape of animal limbs, such as flat frog legs, whereby the appendages provide aerodynamic forces to the play object when the play object is tossed or bounced through the air, thereby affecting the path of travel of the play object through the air, and the rebounding path after the object has been bounced.

BRIEF DESCRIPTION OF THE DRAWINGS

Other objects and advantages will become apparent from the description of the preferred embodiments in conjunction with the accompanying drawings, in which:

FIG. 1 is a front elevation view of the play object of the present invention, illustrated in the form of a simulated baseball having appendages extending therefrom in the form of frog legs;

FIG. 2 is a side elevation view of the play object of FIG. 1;

FIG. 3 is a front elevation view of the play object of FIG. 1, except that the round element is configured in the shape of a simulated volleyball;

DETAILED DESCRIPTION OF THE PREFERRED EMBODIMENTS

Figure 4:
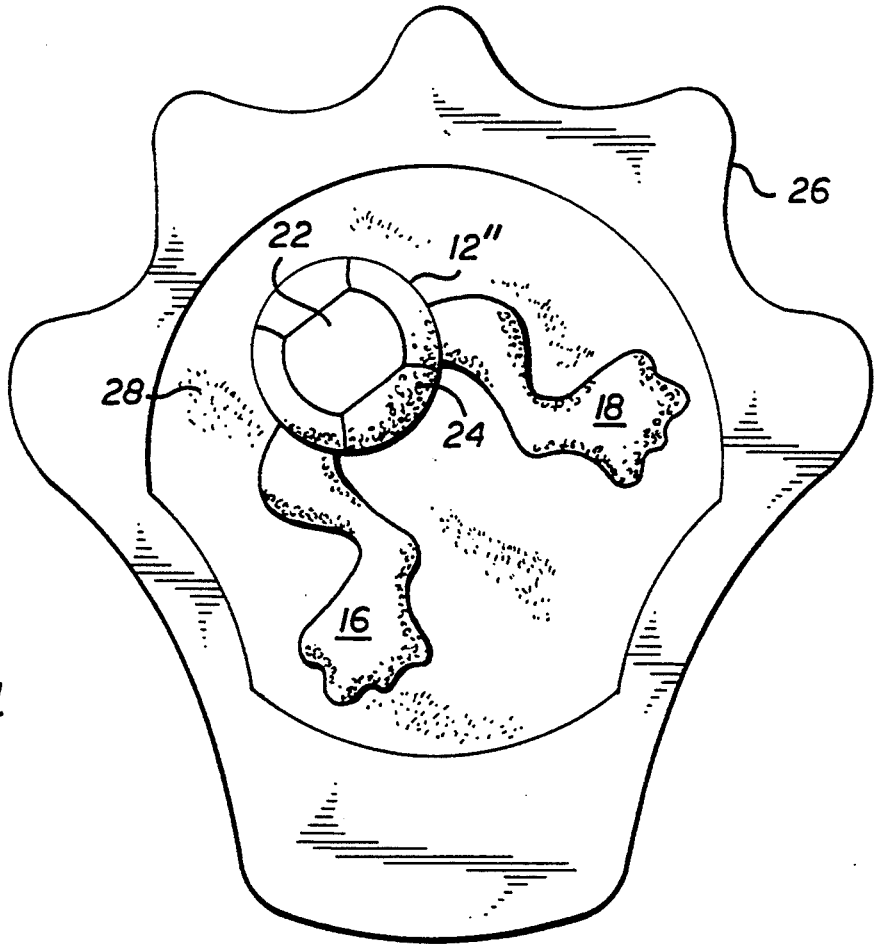
FIG. 4 is a further embodiment of the invention illustrated in FIG. 1, where the spherical portion of the play object is covered with pliable loop-like elements which are adapted to removably attach the play object to a hard receiving surface comprising a plurality of pliable hook-like elements.

Referring to FIG. 1, a first embodiment of the present invention comprises the play object 10, shown in the configuration of a circular or spherical object 12 in the mode of a simulated baseball. The embossed or raised simulated stitching 14 provides both a simulated baseball appearance for the object 12, as well as providing a modicum of aerodynamic forces which are applied to the playing object 10 as it is tossed through the air. If desired, the simulated stitching 14 may be eliminated.

Extending from the circumferential surface of spherical object 12 are a pair of appendages 16, 18, shown in the preferred embodiment as comprising the shape of a pair of frog legs. In keeping within the scope of the invention, the appendages 16, 18 may also simulate any fanciful design, including the appendages of other animals known to children, and other designs such as airplane wings or other mechanical designs. As seen in FIG. 2, appendages 16, 18 are substantially flat in one dimension. The flat surfaces of appendages 16, 18 provide substantial aerodynamic forces on play object 10 when the play object is tossed through the air, as will be explained.

FIG. 3 illustrates another embodiment of the present invention, wherein like numerals are used to designate similar parts of the previous embodiment. In FIG. 3, the circular or spherical object 12' is formed with an embossed outer surface 20 which simulates a volleyball, or a basketball. Frog-leg like appendages 16, 18 extend from the circumferential surface of spherical object 12' in the same manner as described in conjunction with the embodiment of FIG. 1. In the embodiment of FIG. 3, the play object can be bounced as well as tossed and caught.

In use, the play objects of FIGS. 1–3 are designed to be tossed or bounced through the air and caught, back and forth, between two individuals, preferably children. As the flat, frog leg shaped appendages 16, 18 extending from the objects 12, 12' move through the air, aerodynamic forces are created upon the flat surfaces 16, 18 generating varying lift, yaw, and pitch forces which are transferred to the objects 12, 12'. These varying aerodynamic forces provide a generally unpredictable and wavy flight pattern for the objects 12, 12', providing the players with both a novelty item in its variable flight, and a challenge in catching a play object which wobbles during its flight through the air.

In the event, the playing objects 12, 12' are not caught by the person to whom they are tossed, the appendages 16, 18 will prevent the round objects from rolling away from the intended receiver. This is particularly helpful when smaller children are playing with objects 12, 12', whereby they can usually reach the missed object by walking or crawling only a few paces, since the object will not roll away and will be lying not far from the intended receiver. Thus, besides providing an aerodynamic novelty feature to the objects 12, 12', the appendages 16, 18 provide a means for preventing the round objects 12, 12' from rolling out of reach of an intended receiver.

FIG. 4 illustrates an embodiment of the invention whereby the outer surface 22 of spherical object 12" is covered with pliable loop-like elements 24, commonly sold under the tradename VELCRO. The flat frog-leg like appendages 16, 18 are the same as described in conjunction with the embodiments of FIGS. 1–3, and function as described above when object 12" is tossed through the air.

The spherical object 12" of the embodiment of FIG. 4 is adapted to be caught against a flat mitt-like device 26 which includes an area of pliable hook-like elements 28 centrally disposed on one surface of mitt 26. Pliable hook-like elements 28 are also commonly marketed under the tradename VELCRO.

When the spherical object 12" is tossed toward mitt 26, aerodynamic forces acting on flat, frog leg shaped appendages 16, 18 cause object 12" to wobble in flight. Object 12" is ultimately caught by one player using mitt-like device 26, and the surface 22 of object 12" impacts the mitt. Upon impact, loop-like elements 24 engage hook-like elements 28, and object 12" is then removably attached to mitt 26, as is known in the art. The appendages 16, 18 are also covered with pliable attachment elements, and may also adhere to mitt 26. By enabling the appendages 16, 18 to also adhere to mitt 26, the product pose on the mitt is enhanced, and occasionally only the appendages 16, 18 will adhere to the mitt 26. To repeat game play, object 12" is lifted from mitt 26 as pliable elements 24, 28 yield and release the object 12" from the mitt. Preferably, a second player has a similar mitt 26, and the object 12" is tossed by each player towards the second player who likewise catches the object 12" against mitt 26.

Figure 5:
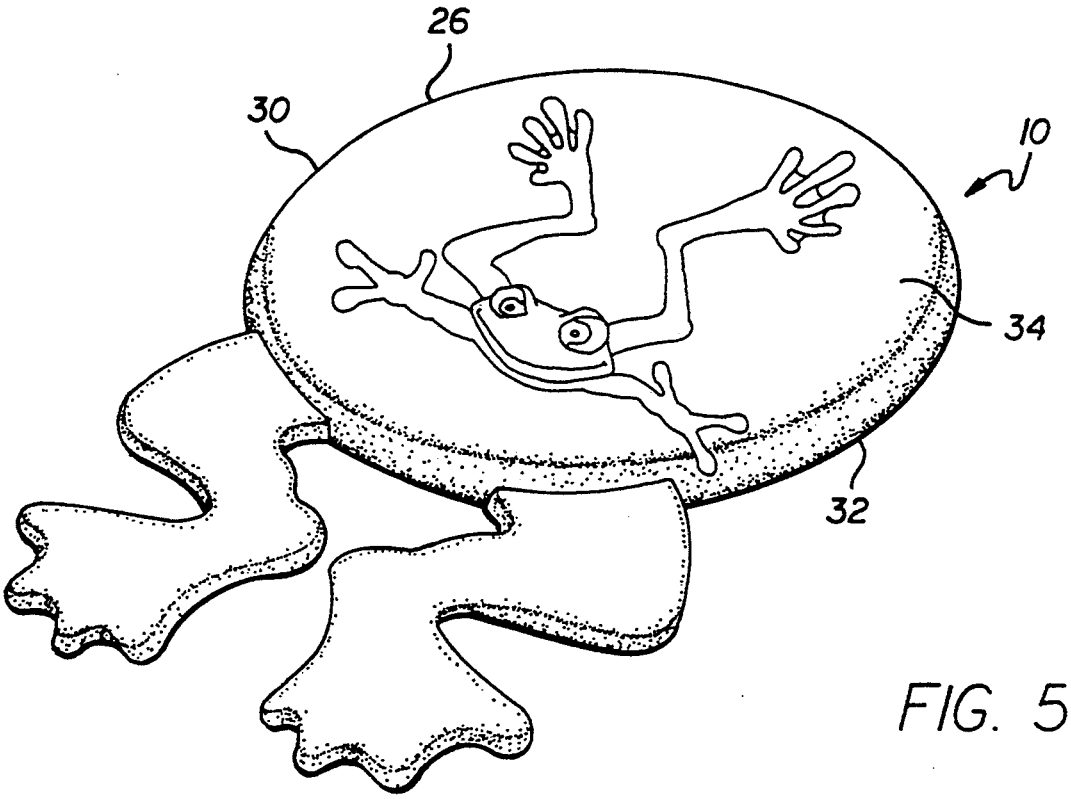
FIG. 5 is a perspective view of the play object of the present invention in the configuration of a flying disc.
Figure 6:
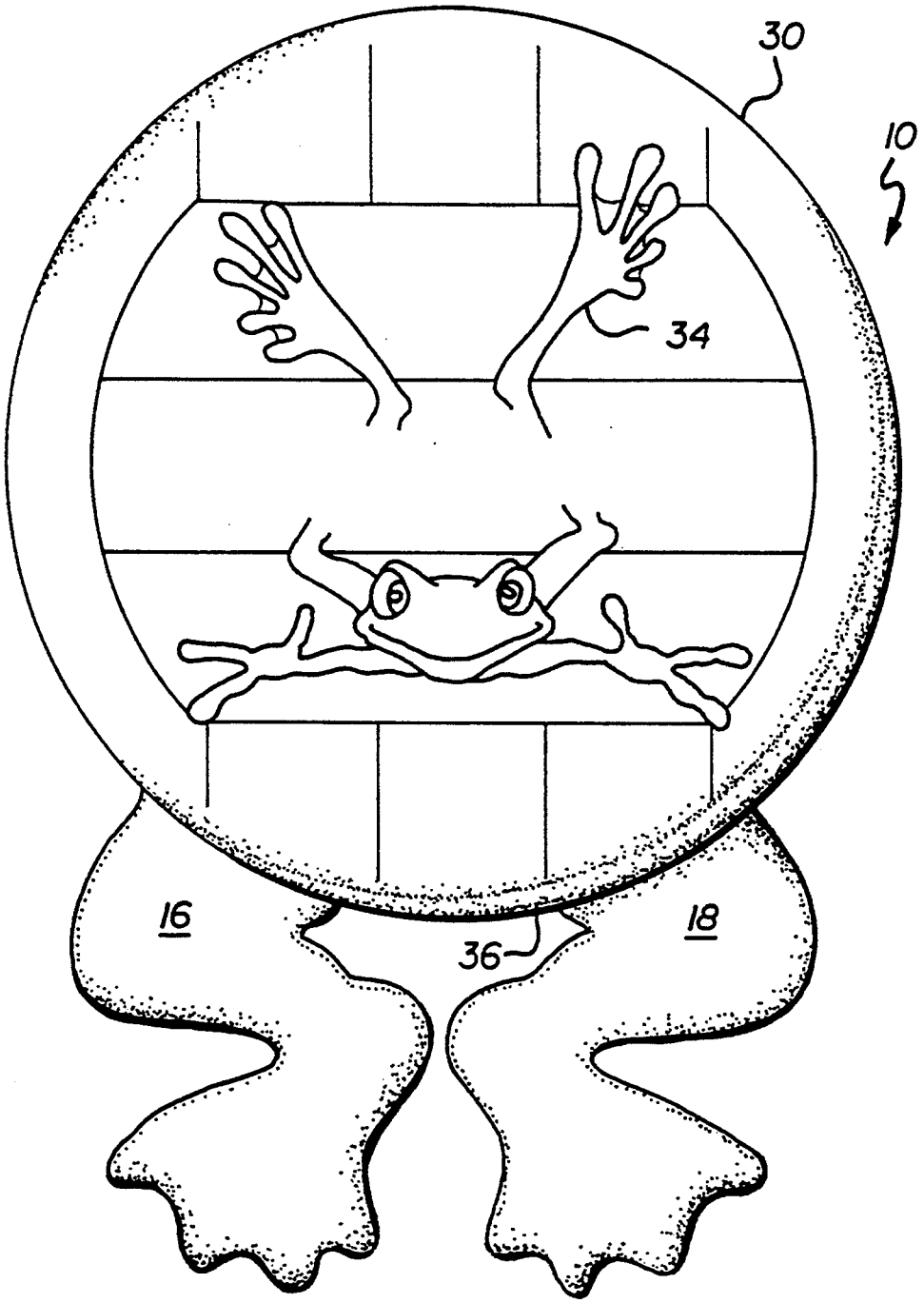
FIG. 6 is a front elevation view of the flying disc embodiment of the invention of FIG. 5.

FIGS. 5 and 6 illustrate an embodiment of the invention wherein play object 10 comprises a flying disc 30 having circumferentially extending turned down edges 32. The flat central portion of disc 30 can optionally include a design and/or logo 34 embossed or otherwise placed thereon. Fanciful, frog leg shaped appendages 16, 18 extend from an edge surface of disc 30, and extend outward from disc 30 in the manner described above in conjunction with the embodiments of FIGS. 1–4.

Discs 30, without appendages 16, 18 are of the type adapted to be tossed through the air by one player and caught by another player. With the addition of flat, frog leg shaped appendages 16, 18, the aerodynamic forces acting upon the appendages are transferred to the disc 30, causing the disc 30 to have a variable and unpredictable flight path through the air. Appendages 16, 18 also provides extra centrifugal force and more lift to disc 30. This increases the challenge to the person catching the disc since the trajectory is changeable, thereby enhancing the excitement of the game.

Each of the embodiments of the invention are contemplated to be made from a rubber or rubber-like composition, or a relatively soft, preferably pliable plastic material. The material should be selected to provide a degree of malleability to the playing object 10, such that it can be hit with a bat-like object, and at the same time not injure someone if the playing object 10 accidentally strikes a part of the body. The present invention also contemplates that the appendages 16, 18 are made of the same material as objects 12, 12' and 12", and disc 30.

Additional games can be played by the various embodiments of the playing object 10 described above and illustrated in FIGS. 1–3. By way of example, the playing object 10 can be tossed back and forth between two players each holding lacrosse sticks. Or, the playing object 10 can be batted back and forth by or between players holding bats, paddles, or racquets. Also, by gripping spherical objects 12 (FIG. 1) in different manners, similar to the various grips used by baseball pitchers, the object 12 can be caused to achieve even more varied flight patterns when tossed through the air.

Referring to the embodiments of the invention shown in FIG. 3, when the volleyball-sized version of the present invention is hit by a player, the return trajectory varies due to the presence of appendages 16, 18, thereby adding another variable and challenging factor to a game. Since appendages 16, 18 are made of a pliable material, if spherical object 12' of FIG. 3 is tossed through a basketball hoop, the appendages 16, 18 will not impede passage of the spherical object through the hoop.

It is to be understood that this invention is not limited to the precise embodiments of the devices shown and described, which are merely by way of illustration and not limitation, as various other forms and modifications will be apparent to those skilled in the art, and it is therefore intended that the appended claims cover all such changes and modifications.

I claim:

1. A unitary play object comprising:

a circular resilient element adapted to be tossed through the air and caught;

appendage means formed of the same material as said circular resilient element and attached at one end to a circumferential surface of said circular resilient element;

said appendage means defining a flat aerodynamic surface extending outwardly normal to said circumferential surface of said circular resilient element in the form of a fanciful shape;

whereby said circular resilient element having said appendage means has varying aerodynamic forces from a circular resilient element without said appendage means when tossed through the air to thereby have an unpredictably varying flight path through the air.

2. The play object of claim 1 wherein said appendage means are in the shape of an animal's limbs.

3. The play object of claim 1 wherein said circular resilient element is in the shape of a substantially spherical ball.

4. The play object of claim 3 wherein said circumferential surface of said ball is substantially covered with pliable loop-like elements which are adapted to engage pliable hook-like elements on a hard surface and removably attach the ball to the hard surface when the ball is tossed against the hard surface.

5. The play object of claim 4 wherein said appendage means also are substantially covered with pliable loop-like elements which are adapted to engage said pliable hook-like elements on said hard surface.

6. The play object of claim 3 wherein said ball-like element is made of resilient plastic material, and said appendages are eccentrically attached.

7. The play object of claim 3 wherein said ball-like element is made of resilient plastic material.

8. The play object of claim 1 wherein said circular resilient element is in the shape of a disc having circumferential edges turned downward.

9. The play object of claim 1 wherein said appendage means are shaped as frog legs.

10. The play object of claim 1 wherein said appendage means are substantially flat in one dimension to provide said aerodynamic forces when said object is tossed.

11. The play object of claim 1 wherein said circular resilient element includes a surface having embossed design features thereon which provide additional aerodynamic forces to the resilient circular element as it is tossed through the air.

* * * * *